US009909741B2

(12) United States Patent
Beghelli

(10) Patent No.: US 9,909,741 B2
(45) Date of Patent: Mar. 6, 2018

(54) WATERTIGHT LIGHTING FIXTURE

(71) Applicant: BEGHELLI S.P.A., Monteveglio (IT)

(72) Inventor: Gian Pietro Beghelli, Monteveglio (IT)

(73) Assignee: BEGHELLI S.P.A., Monteveglio (Bo) (IT)

( * ) Notice: Subject to any disclaimer, the term of this patent is extended or adjusted under 35 U.S.C. 154(b) by 0 days.

(21) Appl. No.: 15/030,354

(22) PCT Filed: Oct. 15, 2014

(86) PCT No.: PCT/IT2014/000269

§ 371 (c)(1),
(2) Date: Apr. 18, 2016

(87) PCT Pub. No.: WO2015/056283

PCT Pub. Date: Apr. 23, 2015

(65) Prior Publication Data

US 2016/0252238 A1 Sep. 1, 2016

(30) Foreign Application Priority Data

Oct. 17, 2013 (IT) ..... VI2013A0253

(51) Int. Cl.
*F21V 31/00* (2006.01)
*F21V 29/00* (2015.01)
(Continued)

(52) U.S. Cl.
CPC ..... *F21V 19/04* (2013.01); *F21V 7/00* (2013.01); *F21V 15/015* (2013.01);
(Continued)

(58) Field of Classification Search
CPC ..... F21V 31/00; F21V 31/005; F21V 31/03; F21V 29/502; F21V 29/503;
(Continued)

(56) References Cited

U.S. PATENT DOCUMENTS

2002/0118537 A1* 8/2002 Segretto ..... F21S 2/005 362/647
2006/0028813 A1 2/2006 Hwang
(Continued)

FOREIGN PATENT DOCUMENTS

EP 2163815 A2 3/2010
EP 2230449 A1 9/2010
EP 2163815 A3 3/2011

OTHER PUBLICATIONS

PCT Search Report in corresponding application dated Jan. 28, 2015.

(Continued)

*Primary Examiner* — Suezu Ellis
(74) *Attorney, Agent, or Firm* — Hedman & Costigan, P.C.; James V. Costigan; Kathleen A. Costigan

(57) ABSTRACT

A watertight lighting fixture, comprising a casing (10), which is closed by a tempered glass (11) at a light emission surface and which has at its ends respective heads (12), connected and fixed to said casing (10); in particular, a slide (14) is placed within said casing (10), on said slide (14) are fixed the wiring terminals (15) of the fixture and below said slide (14) is placed a reflector (16), which is able to spread light outside and which is placed in correspondence of at least one light source, such as at least one neon tube (18) or a plurality of LEDs (17).

6 Claims, 2 Drawing Sheets

(51) Int. Cl.

| | |
|---|---|
| ***F21V 19/04*** | (2006.01) |
| ***F21V 15/015*** | (2006.01) |
| ***F21V 29/83*** | (2015.01) |
| ***F21V 7/00*** | (2006.01) |
| ***F21V 19/00*** | (2006.01) |
| *F21Y 103/00* | (2016.01) |
| *F21Y 103/10* | (2016.01) |
| *F21Y 115/10* | (2016.01) |

(52) U.S. Cl.
CPC ..... *F21V 19/008* (2013.01); *F21V 29/83* (2015.01); *F21V 31/00* (2013.01); *F21V 31/005* (2013.01); *F21Y 2103/00* (2013.01); *F21Y 2103/10* (2016.08); *F21Y 2115/10* (2016.08)

(58) Field of Classification Search
CPC ..... F21V 29/505; F21V 29/507; F21V 7/005; F21Y 2103/00; F21Y 2103/10
USPC ..... 362/217.05, 218, 219, 220, 294
See application file for complete search history.

(56) References Cited

U.S. PATENT DOCUMENTS

| | | | | |
|---|---|---|---|---|
| 2010/0214785 | A1* | 8/2010 | Chen | F21V 7/005 362/267 |
| 2012/0206912 | A1* | 8/2012 | Marquardt | F21S 8/06 362/235 |
| 2012/0236562 | A1 | 9/2012 | Tran | |
| 2012/0250302 | A1 | 10/2012 | Edwards | |

OTHER PUBLICATIONS

Italian Search Report & Written Opinion in corresponding application (partially in English) dated May 20, 2014.

* cited by examiner

WATERTIGHT LIGHTING FIXTURE

The present invention relates, generally, to a watertight lighting device.

More particularly, the invention relates to a IP66 watertight lamp, which can be made in two versions, i.e. using LED light sources or a T5 neon tube.

Known watertight lighting fixtures, which are usable in watertight and anti-corrosive environments, are usually made of plastic or metal and use T5 or T8 type fluorescent lamps.

Said lighting fixtures have a protective screen made of plastic or molded glass or they have a tempered glass sheet; moreover, they can use reflectors for recovering the luminous flux which are made of polished aluminum or metallized plastic.

The protection grade against penetration by liquids or fluids is generally achieved by using a seal, which is placed between the plastic structure and the screen and which is held in place by latches at the perimeter.

The light sources which are used in said lighting fixtures involve a non-negligible dimension of the fixtures (about 1.3-1.5 meters, depending on the type of fluorescent lamps that are used) and, therefore, the perimeter on which the seal gasket works becomes a path that can exceed 3 meters.

Therefore, it follows that the closing hooks distribute the pressure exerted on the gasket in a non-uniform way and, moreover, in most applications, said hooks can become receptacles of dirt, oils, etc., thus making difficult the cleaning operations, which are necessary for the maintenance of the lighting fixture.

Finally, the seal gasket is stressed whenever it becomes necessary to open the fixture in order to make the routine maintenance (for example, for replacing the exhausted fluorescent lamps), with the risk of compromising the sealing grade of the fixture.

A watertight lighting fixture having the technical features of the preamble of the appended claim 1 is known, for example, from EP2230449A1 and from EP2163815A2.

An object of the present invention is therefore to obviate the cited drawbacks, by providing a watertight lighting fixture, which is able to maintain for a long time the seal against penetration by fluids, without the need to use hooks or other closure elements between the body and the screen of the fixture.

Another object of the present invention is to provide a watertight lighting appliance, which allows to achieve a prefixed protection grade against penetration by fluids, according to the laws and regulations.

Another object of the invention is to provide a watertight lighting appliance, which allows to achieve excellent photometric performances.

A further object of the invention is to provide a watertight lighting appliance, which has an excellent quality/price ratio and which is very easy to install and to maintain.

The above mentioned and other objects, according to the present invention, are achieved by providing a watertight lighting fixture, according to the appended claim 1; other technical features and detailed specifications are also given in the dependent claims. Advantageously, the lighting fixture according to the present invention is extremely compact, it has simple shapes and a very low weight, with respect to known watertight lighting devices.

The sealed lamp of the invention, equipped either with LED light sources or with a T5-type fluorescent tube, is certified with an IP66 grade and has an external structure made of pre-galvanized and painted steel; it is closed on the light emission side by means of a tempered glass and at the ends by two plastic end-caps, which are connected to the steel structure by gluing. Moreover, it has a simple mechanism for opening the lamp compartment, which allows an easy cables connection, also maintaining at the same time an aesthetic shape of the structure, an easy opening mechanism and low costs.

Finally, when the fixture is equipped with a neon tube, a plurality of slots are provided for obtaining a proper recirculation of the air flow inside the lamp, in order to improve the heat dissipation inside the lamp compartment, without affecting the optical performances of the lighting fixture.

Further characteristics and advantages of a watertight lighting appliance, according to the present invention, will become more clear from the following description, which refers to a preferred embodiment of the invention, and from the enclosed drawings, in which.

With reference to the mentioned figures, the watertight lighting fixture, which is the object of the present invention, comprises an outer casing 10, made of pre-galvanized and painted steel, which is closed at the light emission side by means of a tempered glass 11 and which is closed at the two ends by means of respective plastic heads or end-caps 12, which are connected to the steel casing 10 by gluing.

Figure 7:
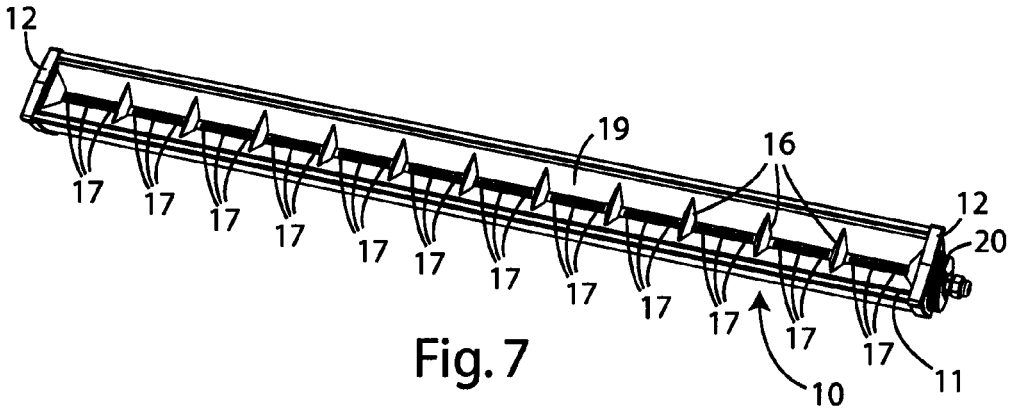
FIG. 7 is a partial perspective view of a further embodiment of the watertight lighting fixture, according to the present invention.

A slide 14 is also placed inside the casing 10 and the wiring terminals 15 are fixed on said slide 14; an aluminum reflector 16 is positioned below the slide 14, said reflector 16 being housed in the cap 19 and being suitable for diffusing light outside; the light source, which is constituted either by a plurality of LEDs 17 (as shown in the appended FIG. 7) or by a neon tube 18, normally a T5-type neon tube is fixed behind the reflector 16.

Therefore, the lighting fixture is extremely compact, it has simple shapes and a very low weight with respect to the known similar lighting devices.

At least one of said end-caps 12 has an opening system which is extremely easy and fast and which includes a removable plug or cap 20 connected to the slide 14.

Figure 1:
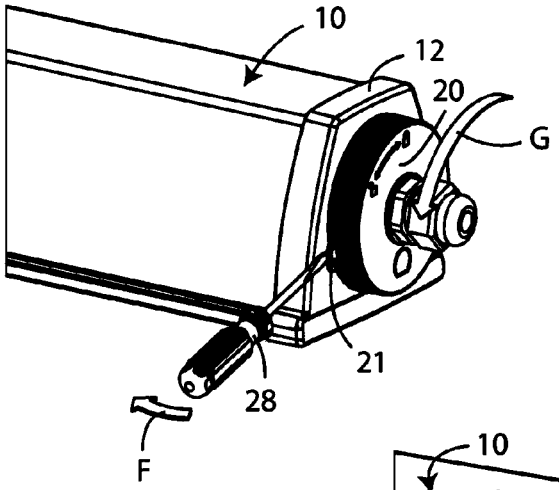
FIG. 1 is a partial perspective view of a first embodiment of a watertight lighting fixture, according to the present invention, in a first opening phase of the external structure.
Figure 2:
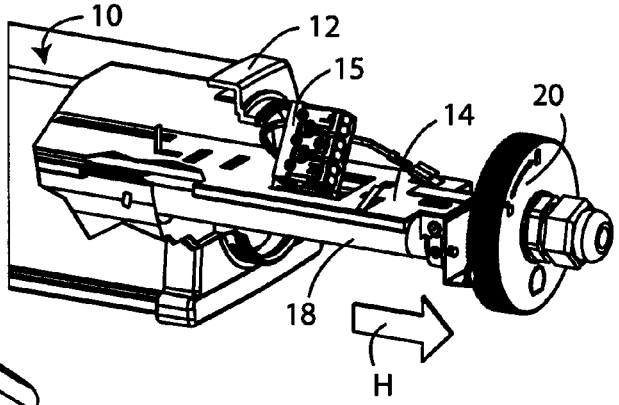
FIG. 2 is a partial perspective view of a first embodiment of a watertight lighting fixture, according to the present invention, in a second opening phase of the external structure.

In practice, in order to open the casing 10 and to have access inside, it is enough to disengage (acting in the direction of the arrow F shown in the appended FIG. 1, and, for example, by means of a screwdriver 28) a tab 21, which constitutes a safety mechanical block in order to prevent accidental opening and which is placed on the plug's edge, and rotate the plug 20 by at least ¼ of a turn (in the direction of the arrow G shown in the appended FIG. 1); thus, it is possible to draw out the whole slide 14, in order to perform the electric wiring and/or to replace the light source, through the plug 20 and by acting in the direction of the arrow H shown in the appended FIG. 2, as well as the lighting device is simply closed by placing the whole slide 14 within the casing 10 and by turning the plug 20 by ¼ of a turn, without using any tool.

It is thus possible to make wiring and to replace the light source in a very easy and fast way without any problems for the installer; for example, the use of a plug 20 which is directly attached to the slide 14 causes that said plug 20 does not remain in the user's hand once unscrewed, thus offering considerable advantages in terms of time and convenience, while the use of the slide 14, as a sliding system which is integrated with the aluminum reflector 16 and which is housed inside the lamp body or shell 19, allows for a quick opening and for an easy connection of the lighting fixture.

Figure 4A:
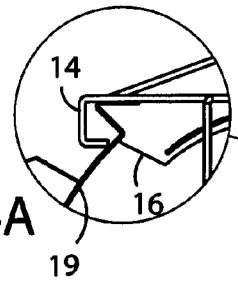
FIG. 4A is an enlarged view of a technical detail of FIG. 4.
Figure 4:
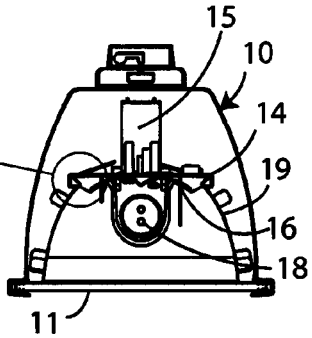
FIG. 4 is a schematic cross-sectional view of the watertight lighting fixture of FIG. 1, according to the present invention.

The slide 14, which slides on the lamp body 19, as shown in the appended FIGS. 2, 4 and 4A, also allows to maintain an aesthetic line of the casing 10, which is easy to make at low costs.

Figure 3:
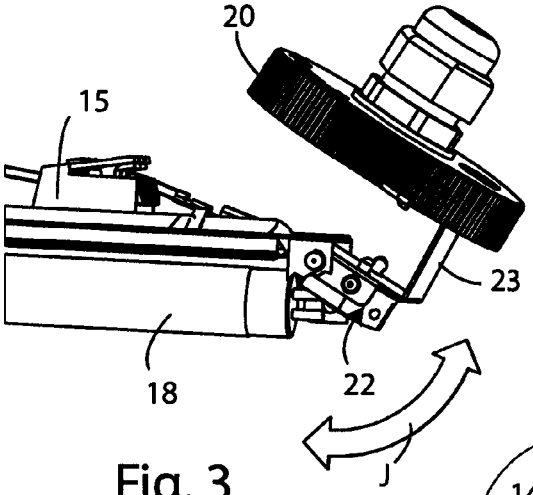
FIG. 3 is a partial perspective view of a first embodiment of a watertight lighting fixture, according to the present invention, in a third opening phase of the external structure.

When the light source is constituted by a neon tube 18, the lamp-holder 22, which is placed at the opening side of the fixture, is mounted on a rotating support 23 (which is fixed, in turn, to the plug 20), which allows, by turning in the direction of the arrow J shown in the appended FIG. 3, to extract or insert the neon tube 18 by simply sliding it along a horizontal direction and without finding the obstacle of said lamp-holder 22; the rotating support 23 is also equipped with a snap retaining system, which keeps the lamp-holder 22 closed on the neon tube 18 when said tube 18 is in an operating position.

Figure 5:
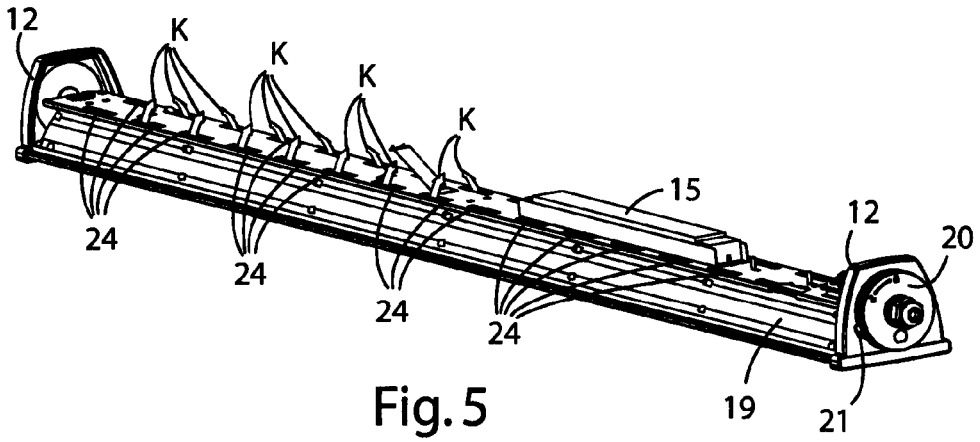
FIG. 5 is a partial perspective view of the watertight lighting fixture of FIG. 1, according to the present invention, in which the inside circulating air flow is shown.
Figure 6:
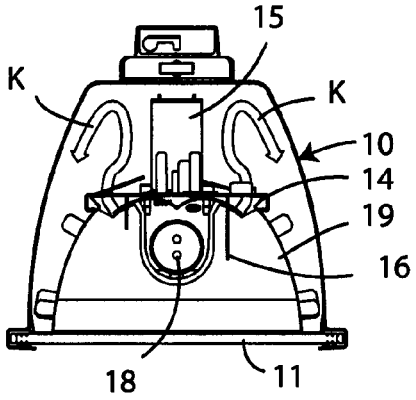
FIG. 6 is a schematic cross-sectional view of the watertight lighting fixture of FIG. 5, according to the present invention.

Finally, when the light source is a neon tube 18, the slide 14 is provided, on the upper portion, with a plurality of through opening slots 24, which allow a proper circulation of the air flow inside the lighting fixture; in fact, the air flows upward, starting from the lamp compartment located below the shell 19 and the reflector 16, by passing through said slots 24 (arrow K of the appended FIG. 5) and by flowing into the area above the slide 14, in order to improve the heat dissipation inside the lamp compartment, without affecting in any way, at the same time, the optical performances of the fixture.

The technical features of the watertight lighting fixture, as well as its technical advantages, according to the invention, are clear from the above description. It is also clear that many other variations can be made to the lighting fixture of the invention, without departing from the principles of novelty inherent in the inventive idea, as well as it is clear that in the practical implementation of the invention, materials, shapes and dimensions of the technical features may be any according to the requirements and they can be replaced with other technically equivalent elements.

The invention claimed is:

1. A watertight lighting fixture, comprising a casing (10) having ends, said casing (10) being closed by a tempered glass (11) at a light emission surface and said casing having at said ends, respective heads (12), connected and fixed to said casing (10), wherein a slide (14) is placed within said casing (10), wherein wiring terminals of said watertight lighting fixture are fixed on said slide and a reflector (16) is positioned below said slide, said reflector (16) being able to spread light outside said casing and being placed in correspondence of at least one light source comprising at least one neon tube (18) or a plurality of LEDs (17), so that said reflector (16) is facing the interior walls of a shell (19), which encloses a housing compartment of said light source, characterized in that said slide (14) has, on its upper portion, a plurality of slots (24), through which air flowing (K) upwardly and above said slide (14) flows, said air coming from said housing compartment of the light source.

2. A lighting fixture according to claim 1, characterized in that a removable cap (20) is connected to said slide (14), said cap (20) being placed in contact with one of said heads (12) in a rest position, when said lighting fixture is closed.

3. A lighting fixture according to claim 2, characterized in that said removable cap (20) has at least one mechanical safety lock and rotates (G) in order to remove and reposition the slide (14) inside the casing (10) of said fixture.

4. A lighting fixture according to claim 1, characterized in that said slide (14) slides on a section of said shell (19).

5. A lighting fixture according to claim 1, characterized in that at least one lamp holder (22), placed in correspondence of said head (12) which is in contact with said removable cap (20), is mounted on a rotary support (23), fixed to said removable cap (20), which allows to extract or insert said light source which slides in a horizontal direction, said light source being constituted by a neon tube (18).

6. A lighting fixture according to claim 1, characterized in that said rotary support (23) is equipped with a snap-retaining system, which closes said lamp holder (22) on said neon tube (18) when the lighting fixture is on.

* * * * *